US008851921B2

(12) United States Patent
Segawa

(10) Patent No.: US 8,851,921 B2
(45) Date of Patent: Oct. 7, 2014

(54) CONNECTOR WITH DETECTION UNIT

(71) Applicant: Sumitomo Wiring Systems, Ltd., Yokkaichi (JP)

(72) Inventor: Hiroki Segawa, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 164 days.

(21) Appl. No.: 13/658,067

(22) Filed: Oct. 23, 2012

(65) Prior Publication Data

US 2013/0130539 A1 May 23, 2013

(30) Foreign Application Priority Data

Nov. 18, 2011 (JP) ..... 2011-252666

(51) Int. Cl.

| | |
|---|---|
| ***H01R 3/00*** | (2006.01) |
| ***H01R 13/627*** | (2006.01) |
| ***H01R 13/703*** | (2006.01) |
| ***H01R 13/641*** | (2006.01) |

(52) U.S. Cl.

CPC ..... *H01R 13/641* (2013.01); *H01R 13/6271* (2013.01); *H01R 13/7031* (2013.01)

USPC ..... 439/489

(58) Field of Classification Search

CPC ..... H01R 13/641; H01R 13/6272; H01R 13/639; H01R 13/7032; H04Q 1/149

USPC ..... 439/489, 188

See application file for complete search history.

(56) References Cited

U.S. PATENT DOCUMENTS

| | | | | | |
|---|---|---|---|---|---|
| 5,464,353 | A | * | 11/1995 | Saijo et al. | 439/489 |
| 5,562,486 | A | * | 10/1996 | Saijo et al. | 439/489 |
| 5,613,872 | A | * | 3/1997 | Fukuda et al. | 439/489 |
| 5,647,754 | A | * | 7/1997 | Kohno | 439/188 |
| 5,647,762 | A | | 7/1997 | Fukuda | |
| 5,743,760 | A | * | 4/1998 | Inaba et al. | 439/489 |
| 5,775,936 | A | * | 7/1998 | Tsuji | 439/489 |
| 5,863,216 | A | * | 1/1999 | Tsuji et al. | 439/489 |
| 6,045,395 | A | * | 4/2000 | Saito et al. | 439/489 |
| 6,126,480 | A | * | 10/2000 | Kawase et al. | 439/489 |
| 6,257,922 | B1 | * | 7/2001 | Shinozaki | 439/489 |
| 6,824,417 | B1 | * | 11/2004 | Nimura | 439/352 |
| 7,294,015 | B2 | * | 11/2007 | Fujii et al. | 439/489 |
| 7,404,730 | B2 | * | 7/2008 | Kobayashi et al. | 439/354 |
| 7,445,491 | B2 | * | 11/2008 | Fujii et al. | 439/489 |
| 7,458,835 | B2 | * | 12/2008 | Kobayashi et al. | 439/188 |

(Continued)

*Primary Examiner* — Amy Cohen Johnson
*Assistant Examiner* — Vladimir Imas
(74) *Attorney, Agent, or Firm* — Gerald E. Hespos; Michael J. Porco; Matthew T. Hespos

(57) ABSTRACT

A connector has a first housing (10) with two detection terminals (13) and a second housing (20) with a resilient deforming portion (25). A detection unit (40) is in the second housing (20) and has two connecting portions (42) that rub against the detection terminals (13) in the process of connecting the two housings (10, 20). The connecting portions (42) are connected to the detection terminals (13) when the housings (10, 20) are connected properly. Fixed contact portions (45) and movable contact portions (50) release a shorted state of the connecting portions (42) as the resilient deforming portion (25) is deformed and short the connecting portions (42) as the resilient deforming portion (25) is resiliently restored. A catch preventing structure (51) prevents foreign matter from being caught at the detection contact portions (45, 50) when the housings (10, 20) are separated.

8 Claims, 12 Drawing Sheets

(56) References Cited

U.S. PATENT DOCUMENTS

| | | | | |
|---|---|---|---|---|
| 7,476,123 | B2 * | 1/2009 | Kobayashi et al. | 439/489 |
| 7,488,197 | B2 * | 2/2009 | Shinozaki | 439/489 |
| 7,591,668 | B2 * | 9/2009 | Nakamura | 439/489 |
| 7,666,026 | B2 * | 2/2010 | Takehara | 439/489 |
| 7,666,027 | B2 * | 2/2010 | Takehara | 439/489 |
| 8,449,319 | B2 * | 5/2013 | Fujii et al. | 439/489 |
| 8,460,025 | B2 * | 6/2013 | Segawa et al. | 439/489 |
| 2003/0087545 | A1 * | 5/2003 | Nimura | 439/352 |
| 2007/0054547 | A1 | 3/2007 | Ohtaka et al. | |
| 2008/0153343 | A1 | 6/2008 | Kobayashi et al. | |
| 2010/0304604 | A1 | 12/2010 | Tonosaki | |

* cited by examiner

CONNECTOR WITH DETECTION UNIT

BACKGROUND OF THE INVENTION

1. Field of the Invention

The invention relates to a connector.

2. Description of the Related Art

U.S. Pat. No. 5,647,762 discloses a connector that detects a connected state based on whether two detection terminals of a detection circuit are shorted. This connector includes a first housing with the two detection terminals, a second housing connectable to the first housing, a lock arm formed in the second housing and configured to deform in the process of connecting the two housings and to restore resiliently when the two housings are connected properly, and a shorting terminal in the second housing. The shorting terminal has a resilient arm that is deformed resiliently in a direction intersecting a connecting direction of the housings as the lock arm is deformed and resiliently restored. The resilient arm is displaced between a state for releasing a shorted state of the detection terminals by moving away from the detection terminals and a state for contacting and shorting the detection terminals.

The detection terminals of the above-described connector enter the second housing and contact the resilient arm when the housings are connected. The long narrow detection terminals are projecting before the two housings are connected. Thus, foreign matter that may adhere to the detection terminals before the housings are connected may be sandwiched between the detection terminal and the resilient arm. In this case, the detection terminals are not shorted even if the housings are connected properly so that an incompletely connected state may be detected erroneously.

The invention was completed in view of the above situation and an object thereof is to improve the reliability of a connection detecting function.

SUMMARY OF THE INVENTION

The invention relates to a connector that has a first housing with two detection terminals and a second housing that is connectable to the first housing. A resilient deforming portion is formed in or on the second housing and is configured to deform in the process of connecting the first and second housings and to restore resiliently when the housings are connected properly. A detection unit is provided in or at the second housing and has two connecting portions that are connected electrically conductively to the detection terminals when the first and second housings are connected properly. Detection contacts release a shorted state of the connecting portions by being set to an off-state as the resilient deforming portion is deformed and short the connecting portions by being set to an on-state as the resilient deforming portion is restored resiliently. At least one catch preventing means prevents foreign matter from being caught at the detection contact portions when the first and second housings are separated.

The corresponding detection terminals and connecting portions are connected electrically conductively in the process of connecting the first and second housings. However, the shorted state between the pair of connecting portions is released since the resilient deforming portion is deformed resiliently. Thus, the two detection terminals are not shorted. The resilient deforming portion restores resiliently when the two housings reach a properly connected state so that the two connecting portions are shorted and the two detection terminals also are shorted. Proper connection of the two housings is detected based on whether the detection terminals are shorted. Further, the catch preventing means prevents foreign matter from being caught at the detection contact portions when the two housings are separated. Therefore, the reliability of a connection detection function is excellent since foreign matter is not caught in a circuit extending from one detection terminal to the other detection terminal via the detection contact portions.

The connecting portions preferably rub or slide against the detection terminals in the process of connecting the first and second housings. Thus, any foreign matter that may adhere to the detection terminal or the connecting portion before the two housings are connected is removed as the detection terminal and the connecting portion rub against each other.

The detection contact portions are kept in the on-state when the first and second housings are separated and there is no clearance between the detection contact portions. Further, the detection contact portions are separated and set to the off-state only in a moment in the process of connecting the two housings. Therefore, foreign matter reliably is prevented from being caught between the detection contact portions.

The detection unit includes two intermediate terminals each of which includes the connecting portion and the detection contact portion and a shorting terminal with two resilient arms that are displaced as the resilient deforming portion is deformed and restore resiliently. A part of detection contact portions are formed on the resilient arms.

A displacing direction of the resilient arm between the short-circuit position and the short-circuit releasing position preferably intersects a connecting direction of the housings.

The detection terminals and connecting portions preferably are connected electrically conductively in the process of connecting the two housings, and the shorted state between the connecting portions is released and the connecting portions are set in a non-conductive state due to the resilient deformation of the resilient deforming portion.

The connection of the first and second housings may be performed or assisted by displacing a movable member from an initial position to a connecting position.

These and other objects, features and advantages of the present invention will become more apparent upon reading of the following detailed description of preferred embodiments and accompanying drawings.

DETAILED DESCRIPTION OF THE PREFERRED EMBODIMENTS

Figure 1:
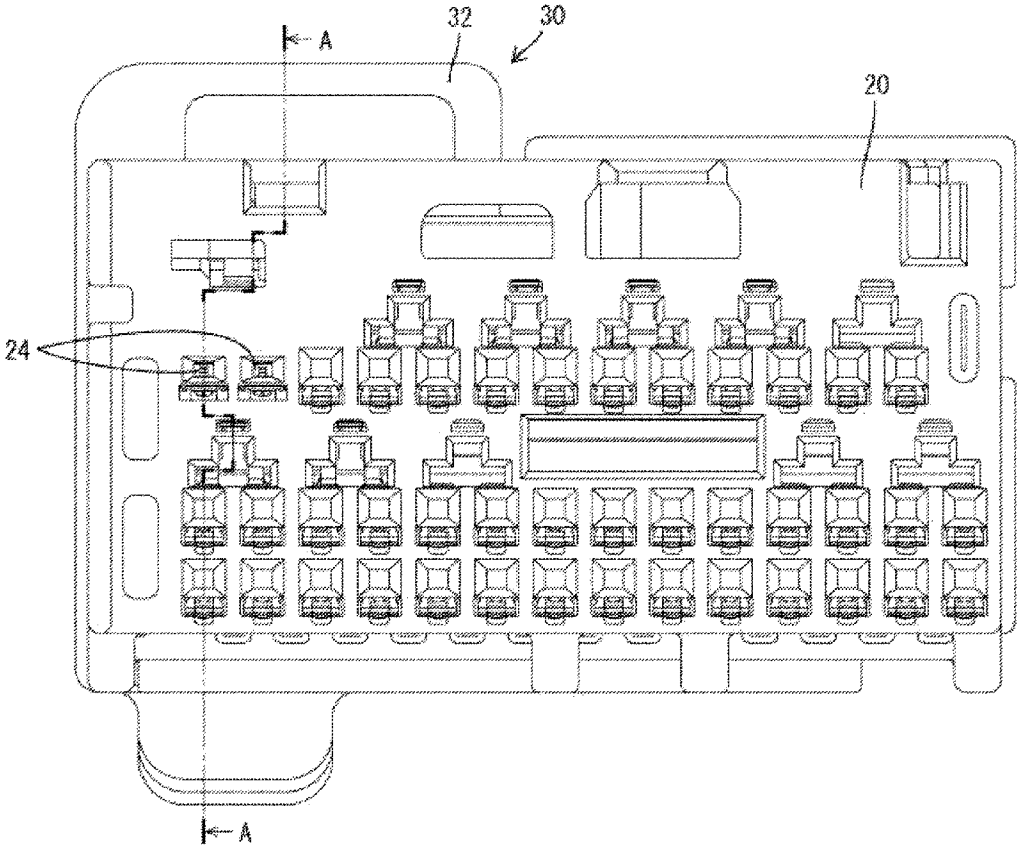
FIG. 1 is a front view of a second housing showing a state where a lever is rotated to a connection position in an embodiment.

A connector in accordance with the invention has a connection detecting function for detecting a connected state based on whether at least one pair of detection terminals 13 of a detection circuit (not shown) are shorted. The connector includes a first housing 10, a second housing 20, a lever 3, two detection terminals 13, a detection unit 40 and catch preventing means 51. In the following description, directions substantially parallel to connecting and separating directions CSD of the first housing 10 and the second housing 20 are referred to as forward and backward directions FBD.

The first housing 10 is made e.g. of an insulating material and includes a terminal holding portion 11 and a tubular receptacle 12 extending forward from the outer peripheral edge of the terminal holding portion 11, as shown in FIGS. 4 to 7. The two detection terminals 13 are long narrow substantially bilaterally symmetric tabs that extend in substantially forward and backward directions FBD and are mounted in the terminal holding portion 11 insulated from each other. The detection terminals 13 are arranged substantially side by side in a lateral direction that intersects the connecting direction CD of the two housings 10, 20. A length direction of the detection terminals 13 is substantially parallel to the connecting direction CD of the two housings 10, 20.

Front ends of both detection terminals 13 project forward from the front surface of the terminal holding portion 11 and are surrounded by the receptacle 12. The front ends of the detection terminals 13 are exposed from the front surface of the terminal holding portion 11 before the two housings are connected and foreign matter can adhere to the detection terminals 13. The receptacle 12 is formed with at least one lock 14 in the form of a projection to be engaged with at least one lock projection 34 when the two housings 10, 20 are connected properly.

The detection circuit detects whether the two housings are connected properly based on whether the detection terminals 13 are shorted (electrically connected). That is, the two housings 10, 20 are determined to be connected properly if a short circuit is detected and the two housings 10, 20 are determined to be in an unconnected state or in an incompletely connected state (in the process of connection and a properly connected state is not reached yet) when detection terminals 13 are not shorted.

Figure 3:
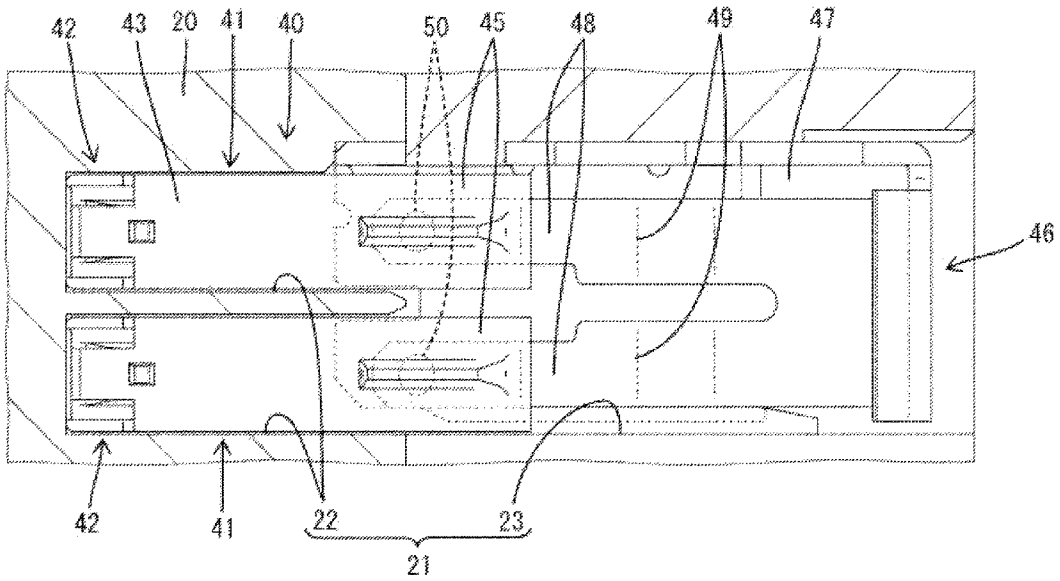
FIG. 3 is a horizontal section showing an arrangement of a pair of intermediate terminals and a shorting terminal.

The second housing 20 is made e.g. of an insulating material and is formed with a terminal accommodating chamber 21, as shown in FIGS. 4 to 7. The terminal accommodating chamber 21 has two front accommodating chambers 22 in a front area of the second housing 20 and a rear accommodating chamber 23 in a rear end area of the second housing 20, as shown in FIG. 3. The front accommodating chambers 22 are arranged side by side in the lateral direction (intersecting the connecting direction CD of the housings 10, 20) particularly similarly to the pair of detection terminals 13. As shown in FIGS. 4 to 7, the front end of each front accommodating chamber 22 is open at the front of the second housing 20 to form a connection opening 24.

Figure 2:
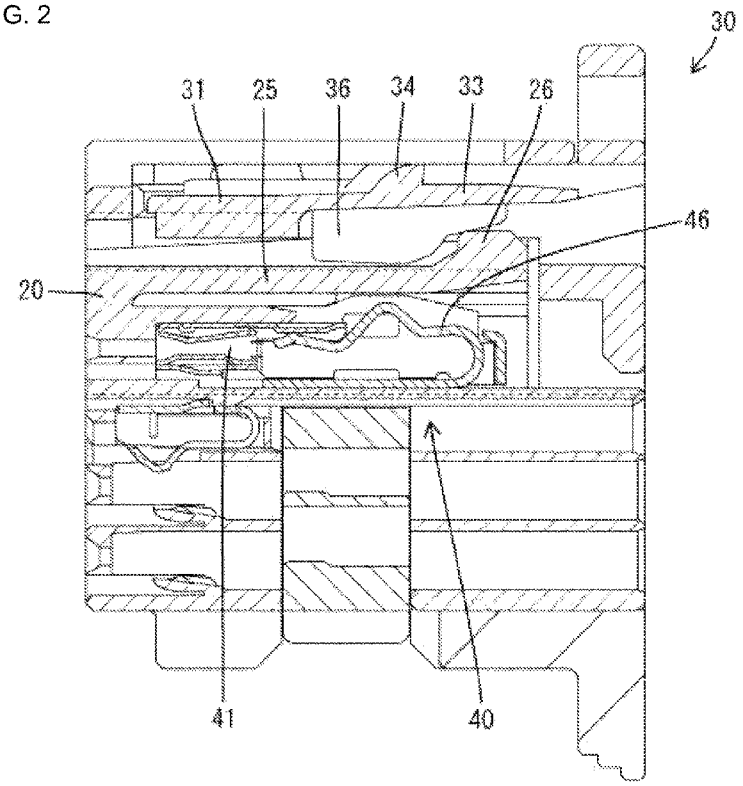
FIG. 2 is a section along A-A of FIG. 1.
Figure 6:
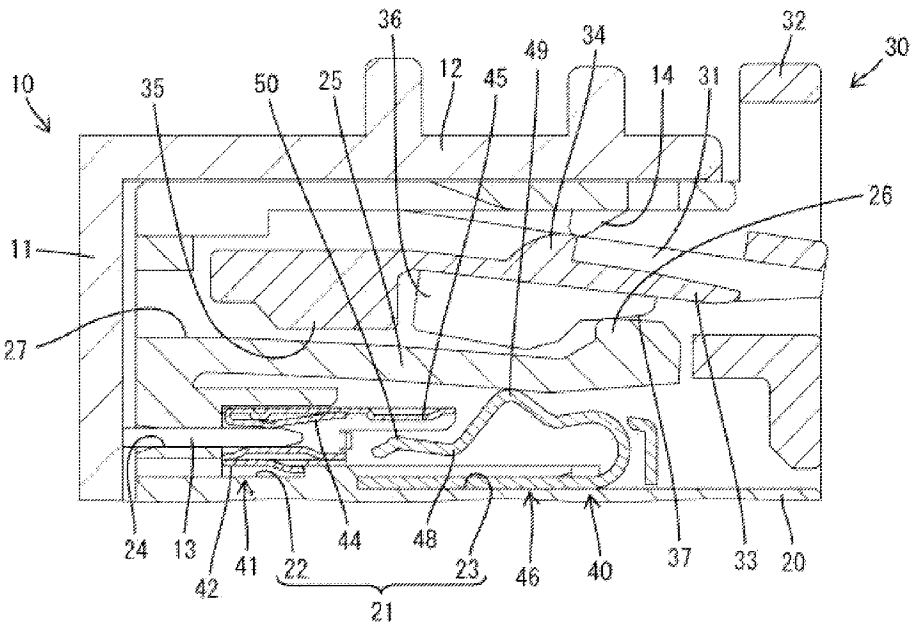
FIG. 6 is a partial enlarged section showing a state where the detection terminals and the intermediate terminals are connected and the intermediate terminals and the shorting terminal are not in contact in the process of connecting of the two housings.
Figure 7:
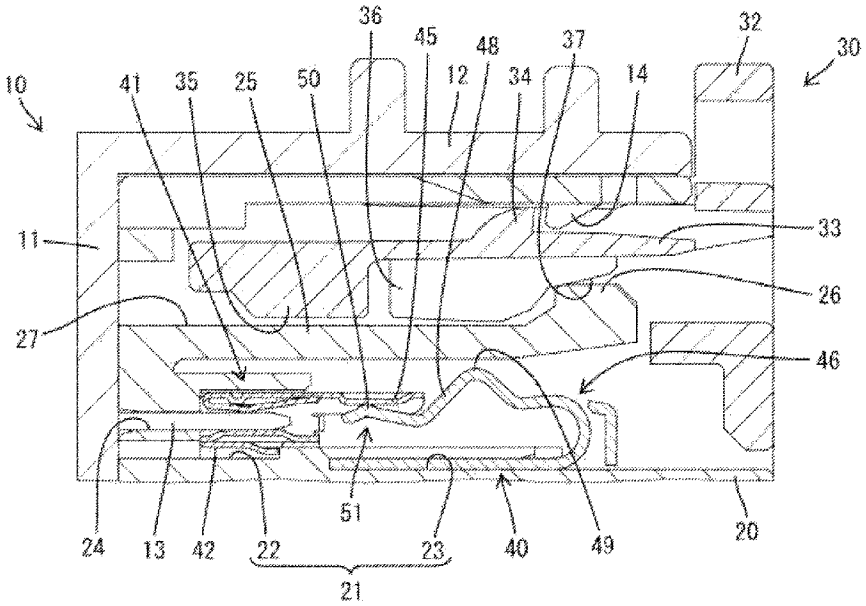
FIG. 7 is a partial enlarged section showing a state where the two housings are properly connected.
Figure 8:
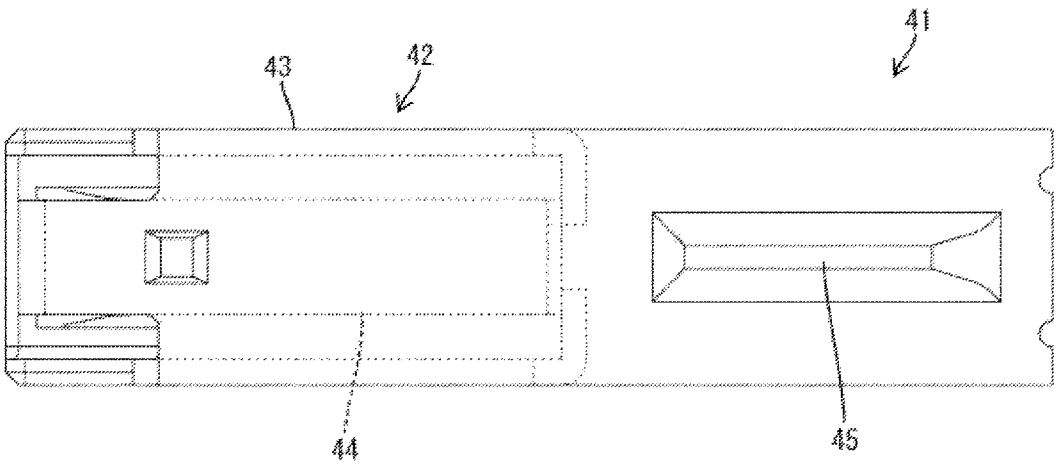
FIG. 8 is a plan view of the intermediate terminal.
Figure 9:
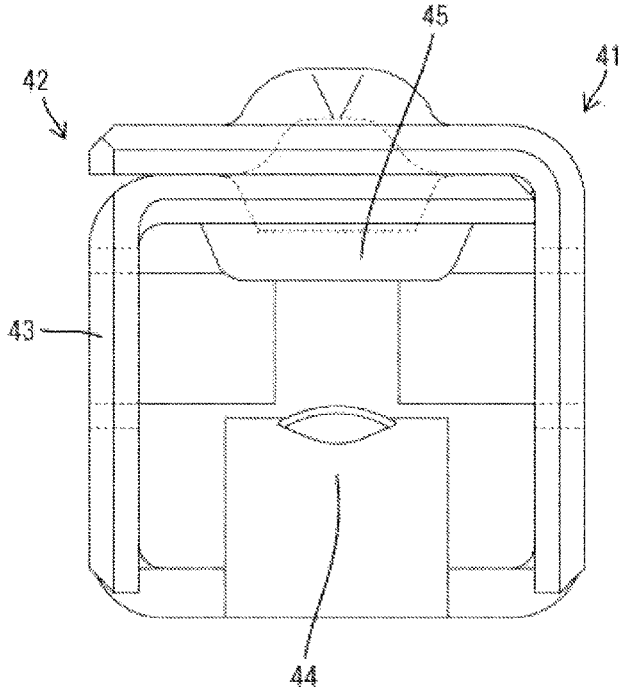
FIG. 9 is a front view of the intermediate terminal.
Figure 10:
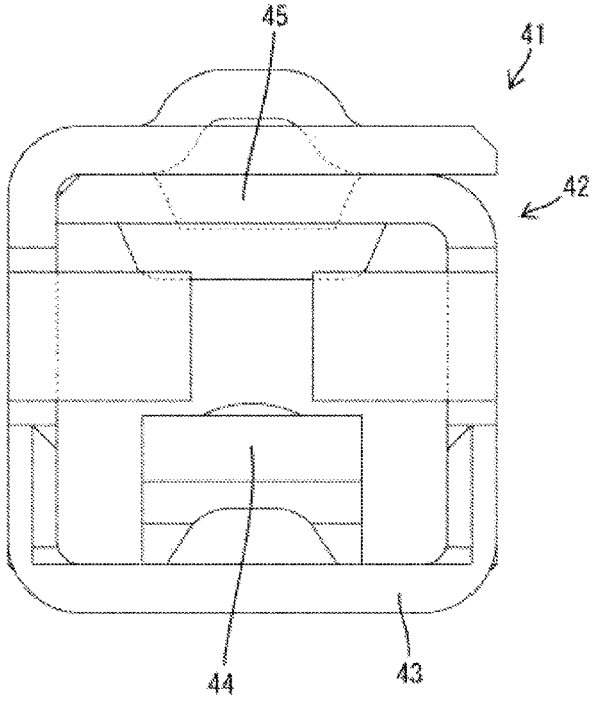
FIG. 10 is a rear view of the intermediate terminal.
Figure 11:
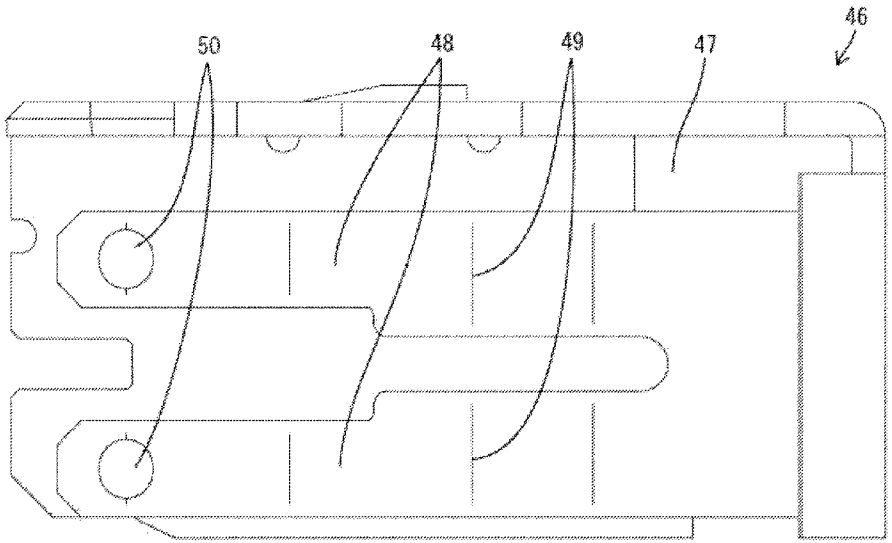
FIG. 11 is a plan view of the shorting terminal.
Figure 12:
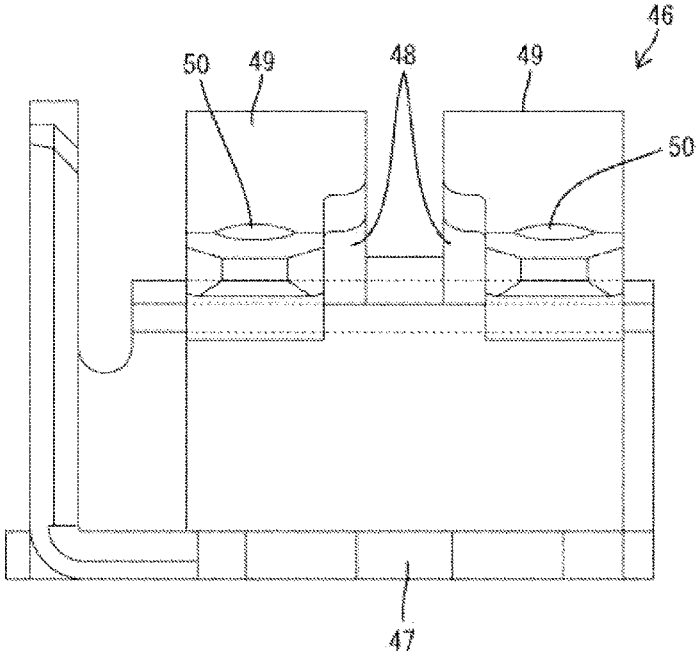
FIG. 12 is a front view of the shorting terminal.

As shown in FIGS. 2 and 7, the detection terminals 13 are inserted respectively in the corresponding front accommodating chambers 22 through the connection openings 24 when the two housings 10, 20 are connected properly. As shown in FIGS. 3 to 7, the rear ends of the front accommodating chambers 22 communicate with the front end of the rear accommodating chamber 23. The rear end of the terminal accommodating chamber 21 is open on the rear surface of the second housing 20 to form at least one terminal insertion hole.

Figure 4:
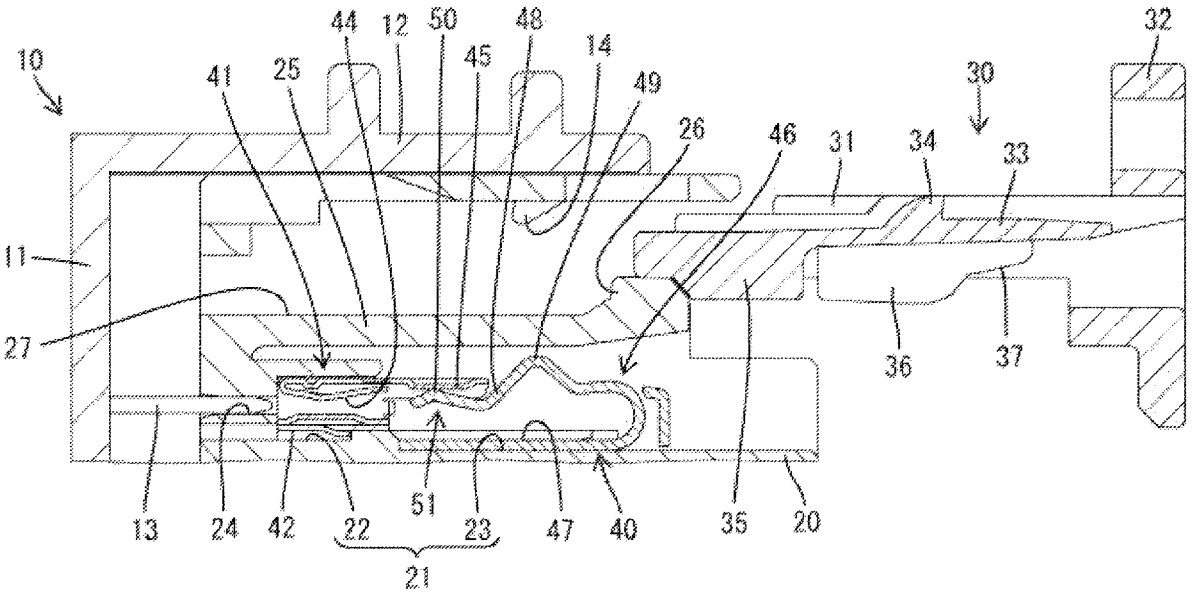
FIG. 4 is a partial enlarged section showing a state when a connecting operation of two housings is started.
Figure 5:
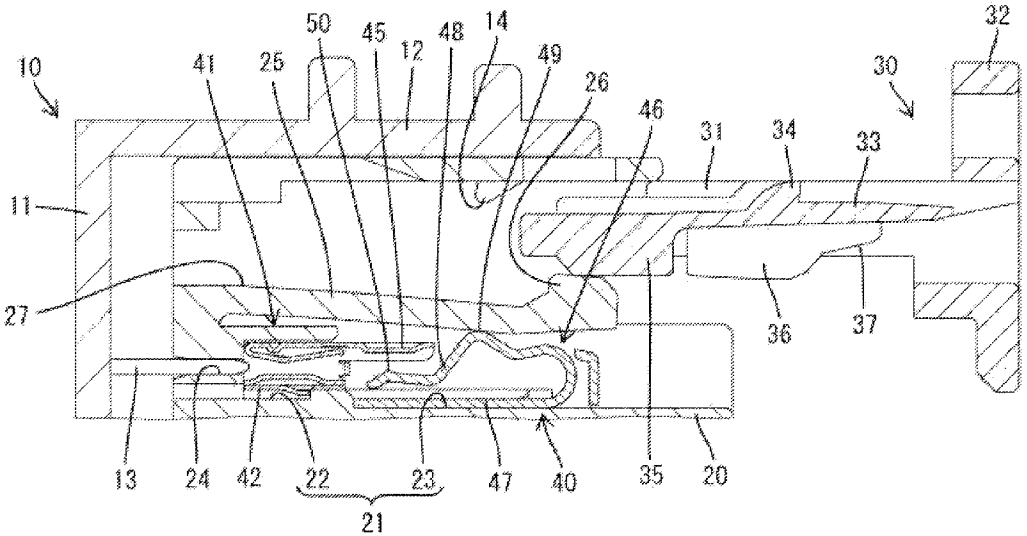
FIG. 5 is a partial enlarged section showing a state where detection terminals and the intermediate terminals are not in contact and the intermediate terminals and the shorting terminal are not in contact in the process of connecting of the two housings.

As shown in FIGS. 5 and 6, at least one resilient deforming portion 25 is formed in the second housing 20 and is deformed resiliently in the connection process with the first housing 10. As shown in FIGS. 4 to 7, the resilient deforming portion 25 is part of an upper wall of the terminal accommodating chamber 21 and is cantilevered back while facing the terminal accommodating chamber 21. An upward or outward projecting protrusion 26 is formed on a rear end part of the resilient deforming portion 25. The lower surface of the resilient deforming portion 25 defines a pressing surface for operating the detection unit 40 to be described later.

As shown in FIGS. 4 and 7, the resilient deforming portion 25 normally is held at a standby position, but is displaceable in response to a pressing force from above to an operating position located below or more inward while inclining with a front end part of the resilient deforming portion 25 as a support, as shown in FIGS. 5 and 6. The rear end part of the resilient deforming portion 25 enters the terminal accommodating chamber 21 when a displacement is made toward the operating position in the second housing 20. An accommodation space 27 for accommodating the lever 30 is formed above the terminal accommodating chamber 21. The upper surface (protrusion 26) of the resilient deforming portion 25 directly faces this accommodation space 27.

The lever 30 is made e.g. of synthetic resin and is mounted on the second housing 20 to be rotatable in a substantially horizontal direction about a vertical supporting shaft (not shown). The lever 30 is displaced rotationally between an initial position IP (see FIG. 4) and a connection position CP (see FIG. 7). As shown in FIGS. 4 to 7, the lever 30 includes a substantially horizontal plate 31, an operating portion 32 formed on a rear part of the plate 31 and a lock arm 33 cantilevered back (toward the operating portion 32 from the front end of the plate 31. As shown in FIG. 4, only front parts of the plate 31 and the lock arm 33 are accommodated in the accommodation space 27 when the lever 30 is at the initial position IP. Further, as shown in FIG. 7, substantially the entire plate 31 and the entire lock arm 33 are accommodated in the accommodation space 27 when the lever 30 moves to the connection position CP.

The lock arm 33 is for locking the two housings 10, 20 in a connected state by engaging the locking portion 14 of the first housing 10 when the second housing 20 is connected properly to the first housing 10. The lock arm 33 normally is held at a locking position LP, as shown in FIGS. 4, 5 and 7, but is resiliently deformable to an unlocking position UP located below or more inward while being inclined with a front part of the lock arm 33 as a support, as shown in FIG. 6, when receiving a pressing force from above or outside. The lock projection 34 is formed on the upper surface of the lock arm 33.

A first pressing portion 35 in the form of a projection is formed on the lower surface of a front end part of the plate 31 facing the upper surface of the resilient deforming portion 25 and is used for operating the detection unit 40 to be described later via the resilient deforming portion 25. A second pressing portion 36 in the form of a projection is formed on the lower surface of the lock arm 33 facing the upper surface of the resilient deforming portion 25 and is used for operating the detection unit 40 via the resilient deforming portion 25. A rear end part of the second pressing portion 36 is recessed up to form an escaping portion 37.

The connection detecting function of the connector is realized by the two detection terminals 13, the resilient deforming portion 25, the lock arm 33 and the detection unit 40. As shown in FIGS. 4 to 7, the detection unit 40 includes left and right intermediate terminals 41 and a single shorting terminal 46.

The intermediate terminal 41 is formed into a shape long in forward and backward directions FBD by applying bending, folding and/or embossing to a conductive metal plate punched or cut out into a specified shape. A front part of the intermediate terminal 41 defines a connecting portion 42 that slides in contact with the detection terminal 13 in the process of connecting the two housings 10, 20. The connecting portion 42 includes a substantially rectangular tube 43 and a resilient contact piece 44 accommodated in the tube 43 while being connected to a plate of the tube 43. A rear part of the intermediate terminal 41 defines a fixed contact 43 (detection contact portion) cantilevered back from the plate of the rectangular tube 43. The fixed contact portion 45 functions as a contact means with the shorting terminal 46.

As shown in FIG. 3, the two intermediate terminals 41 are mounted into the second housing 20 from behind and are accommodated into the terminal accommodating chamber 21. The substantially rectangular tubes 43 are accommodated individually in the front accommodating chambers 22 when the intermediate terminals 41 are mounted, and the fixed contact portions 45 are arranged in the rear accommodating chamber 23 while being separated from each other. Thus, the two detection terminals 13 are mounted in a state where they are not directly in contact with each other.

The shorting terminal 46 is formed by applying bending, folding and/or embossing to a conductive metal plate punched out or cut into a specified shape. The shorting terminal 46 unitarily comprises a main body 47 and two substantially bilaterally symmetric resilient arms 48. The resilient arms 48 extend from the rear end edge of the main body 47 and are bent or folded back to be above the main body 47. Each resilient arm 48 includes a pressure receiving portion 49 and a movable contact portion 50. The pressure receiving portion 49 is formed between a rear end and a front end of the resilient arm 48 and is bent to have a mountain or pointed shape projecting up. The movable contact portion 50 is formed on or near the front end part (extend end part) of the resilient arm 48 and is bent to project up.

The shorting terminal 46 is mounted into the second housing 20 from behind and is accommodated into the rear accommodating chamber 23. The resilient restoring forces of the resilient arms 48 individually and resiliently hold the movable contact portions 50 in contact with the fixed contact portions 45 when the shorting terminal 46 is mounted and the two housings 10, 20 are unconnected (separated), as shown in FIGS. 4 and 7. Accordingly, the shorting terminal 46 shorts the intermediate terminals 41 to each other. At this time, the resilient arms 48 are at short-circuit positions. Further, as shown in FIGS. 5 and 6, the movable contact portions 50 are separated from the fixed contact portions 45 when the resilient arms 48 are deformed resiliently to short-circuit releasing positions located at a distance below. Thus, the intermediate terminals 41 are released from the shorted state. A displacing direction of the resilient arm 48 between the short-circuit position and the short-circuit releasing position intersects the connecting direction CD of the two housings 10, 20.

The catch preventing means 51 is for preventing a foreign matter from being caught between the fixed contact portion 45 and the movable contact portion 50 when the first and second housings 10, 20 are separated. Specifically, in the state where the first and second housings 10, 20 are separated and the lever 30 is at the initial position IP, the movable contact portions 50 are resiliently in contact with the fixed contact portions 45 and the contact portions 45, 50 are kept in an on-state as shown in FIG. 4. Thus, foreign matter is not caught between the contact portions 45, 50. This configuration functions as the catch preventing means 51.

The lever 30 is at the initial position IP (see FIG. 4) before the two housings 10, 20 are connected and the lock arm 33 is retracted away from the resilient deforming portion 25 in this state. Thus, the resilient deforming portion 25 is held at the standby position and the resilient arms 48 are held at the short-circuit positions. Therefore, the movable contact portions 50 and the fixed contact portions 45 are in the on-state to be resiliently held in contact and the connecting portions 42 are in a shorted state. Further, the contact portions 45, 50 are held directly resiliently in contact so that foreign matter is not caught between the contact portions 45, 50.

The two separated housings 10, 20 can be fit lightly together so that leading ends of the detection terminals 13 enter the connection openings 24, but the detection terminals 13 and the connecting portions 42 are not in contact electrically, as shown in FIG. 4. The lever 30 then is displaced so that the connecting operation of the housings 10, 20 progresses by the engagement of a cam groove (not shown) formed in the lever 30 and a cam follower (not shown) formed on the first housing 10.

The front part of the plate 31 enters the accommodation space 27 as the lever 30 is rotated and the first pressing portion 35 presses the protrusion 26 of the resilient deforming portion 25 from above. As a result, the resilient deforming portion 25 is displaced resiliently down from the standby position to the operating position and the pressing surface of the resilient deforming portion 25 presses the pressure receiving portions 49 of the resilient arms 48 from above, as shown in FIG. 5. Thus, the two resilient arms 48 are displaced resiliently from the short-circuit positions to the short-circuit releasing positions located below and the movable contact portions 50 are separated from the fixed contact portions 45. In this way, the contact portions 45, 50 are set to an off-state and the shorted state of the connecting portions 42 of the intermediate terminals 41 is released. During this time, the detection terminals 13 are kept in a noncontact state with the intermediate terminals 41.

The connecting operation of the housings 10, 20 progresses as the lever 30 is rotated further and the two detection terminals 13 contact the corresponding connecting portions 42. The shorted state between the two connecting portions 42 is kept released so that the two detection terminals 13 also are kept in a short-circuit released state. The lever 30 is inserted more into the accommodation space 27 so that the first pressing portion 35 of the plate 31 passes the protrusion 26 of the resilient deforming portion 25, but the second pressing portion 36 of the lock arm 33 keeps pressing the protrusion 26. Thus, the resilient deforming portion 25 is held at the operating position and the shorted states of the pair of detection terminals 13 and the connecting portions 42 are kept released.

The housings 10, 20 connect more deeply as the lever 30 is rotated farther. Thus, the lock projection 34 interferes with the locking portion 14 and the lock arm 33 is resiliently displaced down from the locking position LP toward or to the unlocking position UP, as shown in FIG. 6. At this time, the protrusion 26 substantially corresponds to the upward retracted escaping portion 37 of the second pressing portion 36, the resilient arms 48 are held at the short-circuit releasing positions without being excessively deformed.

The two housings 10, 20 are connected properly when the lever 30 reaches the connection position CP. At this time, the lock arm 33 resiliently restores from the unlocking position UP to the locking position LP, and the lock projection 34 engages the locking portion 14 to lock the two housings 10, 20 in the properly connected state shown in FIG. 7. Further, the second pressing portion of the lock arm 33 releases the protrusion 26 as the lock arm 33 resiliently restores. Thus, the resilient deforming portion 25 is restored resiliently from the operating position to the standby position. In this way, the movable contact portions 50 come into contact with the fixed contact portions 45 so that both contact portions 45, 50 are set to the on-state, and the detection terminals 13 are shorted via the intermediate terminals 41 and the shorting terminal 46.

The connector of this embodiment includes the first housing 10 with the two detection terminals 13, the second housing 20 to be connected to the first housing 10, the resilient deforming portion 25 formed in the second housing 20 and configured to deform in the process of connecting the housings 10, 20 and to restore resiliently when the housings 10, 20 are connected properly, and the detection unit 40 in the second housing 20. The detection unit 40 includes the connecting portions 42 to be connected electrically conductively to the detection terminals 13 when the detection terminals 13 rub against each other and the two housings 10, 20 are connected properly. At this stage, the fixed contact portions 45 and the movable contact portions 50 for releasing the shorted state of the connecting portions 42 are set to the off-state as the resilient deforming portion 25 is deformed, thereby by being set to the on-state as the resilient deforming portion 25 is restored resiliently and shorting the connecting portions 42. Further, the catch preventing means 51 prevents foreign matter from being caught between the detection contact portions (e.g. between the movable contact portions 50 and the fixed contact portions 45) when the two housings 10, 20.

According to the thus configured connector, the detection terminals 13 and the corresponding connecting portions 42 are connected electrically conductively connected in the process of connecting the two housings 10, 20, but the shorted state between connecting portions 42 is released and the connecting portions 42 are set in a non-conductive state due to the resilient deformation of the resilient deforming portion 25. Thus, the detection terminals 13 are not shorted. The resilient deforming portion 25 restores resiliently when the two housings 10, 20 reach the properly connected state so that connecting portions 42 are connected electrically conductively to short the detection terminals 13. Therefore, whether the housings 10, 20 are connected properly can be detected based on whether the detection terminals 13 are shorted.

The contact portions 45, 50 are set to the off-state before the detection terminals 13 and the connecting portions 42 come into contact, as shown in FIG. 5, in the process of connecting the housings 10, 20. Thus, the detection terminals 13 are not shorted during the connecting operation of the two housings 10, 20 and there is no likelihood that the proper connection of the housings 10, 20 is detected erroneously due to shorted detection terminals 13 when the two housings 10, 20 are not connected properly.

The detection terminals 13 and the connecting portions 42 rub or slide against each other in the process of connecting the first and second housings 10, 20. Foreign matter may adhere to the detection terminal 13 or the connecting portion 42 before the housings 10, 20 are connected. However, that foreign matter is removed by the detection terminal 13 and the connecting portion 42 rubbing or sliding against each other. Further, the catch preventing means 51 keeps the between the movable contact portion 50 in contact with the fixed contact portion 45 when the housings 10, 20 are separated to prevent foreign matter from being caught. Thus, foreign matter is not caught in a circuit extending from one detection terminal 13 to the other detection terminal 13 via the detection contact portions (movable contact portions 50 and fixed contact portions 45) to ensure a highly reliable connection detecting function.

The movable contact portions 50 and the fixed contact portions 45 are kept in the on-state when the two housings 10, 20 are separated and there is no clearance between the contact portions 45, 50. The contact portions 45, 50 are separated and set to the off-state only in a moment in the process of connecting the two housings 10, 20. Thus, foreign matter reliable is prevented from being caught between the contact portions 45, 50.

Using the detection unit 40 in the second housing 20 to short detection terminals 13 in the first housing 10, as described above, improves the reliability of the resilient deforming portion. In this technical idea, a circuit is divided into the pair of detection terminals 13 and the detection unit 40. The detection terminals 13 and the detection unit 40 function as wiping contacts that slide in contact with each other in the process of connecting the housings 10, 20. Further, the detection unit 40 has a switching function for releasing the shorted state of the detection terminals 13 by being temporarily opened in the process of connecting the two housings 10, 20 and shorting the pair of detection terminals 13 by being closed when the two housings 10, 20 are connected properly. This switching function is realized by separating the detection unit 40 into two intermediate terminals 41 and one shorting terminal 46. This configuration prevents foreign matter from being caught at contacts which are opened and closed in the process of connecting the two housings 10, 20.

The circuit for shorting the pair of detection terminals is separated into a wiping unit comprising the pair of detection terminals 13 and the pair of intermediate terminals 41, and the shorting terminal 46. The detection terminals 13 and the intermediate terminals 41 of the wiping unit function as wiping contacts. Further, the intermediate terminals 41 and the shorting terminal 46 have a switching function for shorting the detection terminals 13 and releasing the shorted state of the detection terminals 13. This configuration also prevents foreign matter from being caught at contacts that are opened and closed in the process of connecting the two housings 10, 20.

The invention is not limited to the above described embodiment. For example, the following embodiments are included in the scope of the invention.

The detection unit has three components, i.e. two intermediate terminals and one shorting terminal and there are two pairs of detection contact portions in the above embodiment. However, the detection unit may have two components by uniting one intermediate terminal and the shorting terminal to have only two detection contact portions.

The resilient deforming portion is used exclusively as a connection detecting means and is provided separately from the lock arm for locking the two housings in the connected state in the above embodiment. However, the lock arm also may be provided with the function of the resilient deforming portion as the connection detecting means.

The detection contact portions are brought into contact and kept in the on-state before the two housings are connected as the catch preventing means for preventing foreign matter from being caught at the detection contact portions in the above embodiment. However, the detection contact portions may be accommodated in the accommodation space in the second housing and an opening of the accommodation space may be closed by a cover or the like to prevent the entrance of foreign matter, thereby preventing the foreign matter from being caught at the detection contact portions. In this case, the detection contact portions may not be in contact with each other when the two housings are separated.

The detection terminals are in the form of long narrow tabs and the connecting portions of the intermediate terminals are resilient contact pieces. Conversely, the detection terminals may include resilient contact pieces and the connecting portions of the intermediate terminals may be in the form of long and narrow tabs.

The first and second housings are connected using the lever in the above embodiment. However, the invention can be applied also in the case of connecting first and second housings without using a lever or in which a lever performs a movement different than a rotation or pivotal movement such as a substantially linear movement.

What is claimed is:

1. A connector, comprising:

a first housing including two detection terminals;

a second housing connectable to the first housing;

a resilient deforming portion formed on the second housing and configured to be resiliently deformed in the process of connecting the first and second housings and to restore resiliently when the first and second housings are connected properly;

a detection unit in the second housing and including two connecting portions that are connected electrically conductively to the detection terminals when the first and second housings are connected properly and detection contacts for releasing a shorted state of the connecting portions by being set to an off-state as the resilient deforming portion is deformed resiliently and shorting the connecting portions by being set to an on-state as the resilient deforming portion is restored resiliently; and catch preventing means for preventing foreign matter from being caught at the detection contacts when the first and second housings are separated.

2. The connector of claim 1, wherein the connecting portions rub against the detection terminals in the process of connecting the first and second housings.

3. The connector of claim 2, wherein the catch preventing means is formed by keeping the detection contacts when the first and second housings are separated.

4. The connector of claim 1, wherein the detection unit includes: two intermediate terminals each including the connecting portion and the detection contact portion; and a shorting terminal.

5. The connector of claim 4, wherein the shorting terminal includes two resilient arms that are resiliently displaced as the resilient deforming portion is deformed and resiliently restore, a part of detection contact portions being formed on the resilient arms.

6. The connector of claim 4, wherein a displacing direction of the resilient arm between the short-circuit position and the short-circuit releasing position intersects a connecting direction of the two housings.

7. The connector of claim 1, wherein the detection terminals and connecting portions are connected electrically conductively in a process of connecting the two housings, and the shorted state between the connecting portions is released and the connecting portions are set in a non-conductive state due to the resilient deformation of the resilient deforming portion.

8. The connector of claim 1, wherein the connection of the first and second housings is performed or assisted by displacing a movable member from an initial position to a connecting position.

* * * * *